United States Patent [19]

Ferlier et al.

[11] Patent Number: 4,808,966

[45] Date of Patent: Feb. 28, 1989

[54] LASER-MARKABLE ELECTRIC CABLE

[75] Inventors: Jean-Pierre Ferlier, Yerres; Michel Maréchal, Combs la Ville, both of France

[73] Assignee: Filotex, Draveil, France

[21] Appl. No.: 81,957

[22] Filed: Aug. 5, 1987

[30] Foreign Application Priority Data

Aug. 5, 1986 [FR] France ..... 8611319

[51] Int. Cl.[4] ..... H01C 3/06

[52] U.S. Cl. ..... 338/214; 219/121.68

[58] Field of Search ..... 219/121 LJ, 121 LH, 219/121 LL, 121 LK, 121 LG, 121 LN, 121.68, 121.69, 121.7, 121.71, 121.67, 121.72; 338/315

[56] References Cited

U.S. PATENT DOCUMENTS 3,505,916 4/1970 Brandt ..... 82/54
3,718,840 2/1973 Tanaka et al. ..... 338/214 X
4,370,542 1/1983 Mills et al. ..... 215/121 LJ X
4,375,632 3/1983 Miyamoto et al. ..... 338/214

FOREIGN PATENT DOCUMENTS 3147230 6/1983 Fed. Rep. of Germany .
2555799 5/1985 France .

*Primary Examiner*—C. L. Albritton
*Attorney, Agent, or Firm*—Sughrue, Mion, Zinn, Macpeak, and Seas

[57] ABSTRACT

A laser beam markable electric cable comprising an outer layer (13) enabling such marking to be performed, wherein said outer layer (13) is of a contrasting color relative to the color of an underlayer (14) which is absorbent at the laser beam wavelength. Said outer layer (13) is a thin layer which, during marking, is destroyed through its entire thickness by the laser beam (10) so as to reveal the underlayer (14).

13 Claims, 1 Drawing Sheet

LASER-MARKABLE ELECTRIC CABLE

The invention relates to an electric cable capable of being marked by a laser.

BACKGROUND OF THE INVENTION

In order to mark a cable in this way using a laser, German Pat. No. 3,147,230 describes a cable whose outer surface is initially sprayed with a colored coating which is baked using high-frequency waves or infra-red waves and which is subsequently burned using laser radiation. However, this document is concerned solely with the surface burning obtained by the laser radiation.

U.S. Pat. No. 4,370,542 claims cable marking by means of a laser, but it relates, in fact, solely to the relative positioning of the cable and the laser source.

There exist other prior art documents relating to marking various types of surfaces for identification purposes (e.g. plastics), or else for preparing stencils or lithographic plates. In some of these documents, and in particular in European Pat. No. 159,529 and French Pat. No. 2,520,902, the marking technique makes use of two surface layers, one of which absorbs laser radiation while the other, outer layer, is transparent.

U.S. Pat. No. 3,505,916 proposes distinguishig two insulated conductors by means of two successive layers of insulation having different colors. This document describes identifying insulated conductors by mechanically cutting a spiral in the outer layer of each conductor, with the cut exposing an underlayer which contrasts relative to the outer layer. However, such a method is incapable of putting genuine inscriptions on a conductor.

In contrast, the present invention seeks to provide a special disposition for the outer layer of an electric cable enabling it to be marked by a laser beam.

SUMMARY OF THE INVENTION

To this end the present invention provides a laser beam markable electric cable comprising an outer layer enabling such marking to be performed, wherein said outer layer is of a contrasting color relative to the color of an underlayer which is absorbent at the laser beam wavelength, said outer layer being a thin layer which, during marking, is destroyed through its entire thickness by the laser beam so as to reveal the underlayer.

Such a disposition allows finer and more accurate marking to be obtained than is possible solely under the effect of more or less superficial burning of a thick material.

Advantageously, the invention provides an electric cable in which the outer layer is pale in color while the underlayer is dark in color, and in which the outer layer is between 5 micrometers and 50 micrometers thick.

BRIEF DESCRIPTION OF THE DRAWINGS

Embodiments of the invention are described by way of example with reference to the accompanying drawing, in which.

MORE DETAILED DESCRIPTION

Figure 1:
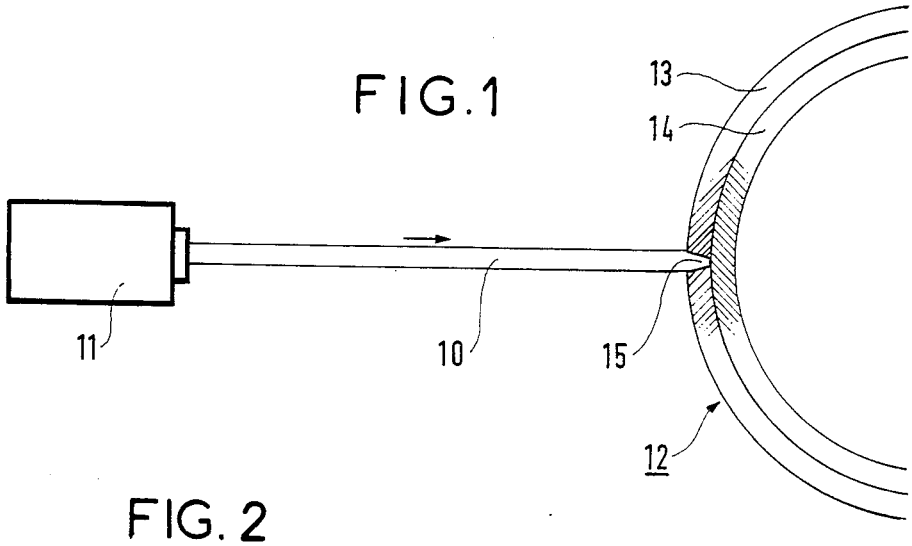
FIG. 1 shows a laser-markable electric cable in accordance with the invention.

FIG. 1 shows laser beam marking in accordance with the invention. A beam 10 coming from a laser source 11 is directed onto the surface of an electric cable 12. The cable has a thin outer layer 13 which may be 5 micrometers to 50 micrometers thick, for example, and which surrounds an underlayer 14. The entire thickness of the outer layer is destroyed at the point of impact 15 of the laser beam thereon, thereby allowing the underlayer 14 which absorbs said laser beam to show through.

Since the outer layer 13 is in a contrasting color compared with the underlayer, e.g. the outer layer is pale and the underlayer is dark, the invention makes it possible to obtain high-quality marking.

By way of non-limiting example, the underlayer 14 which must be absorbent at the laser wavelength used, e.g. lambda = 1.06 um for a YAG laser or lambda = 10.6 um for aa $CO_2$ laser, may have the following characteristics:

the underlayer 14 may be made of polytetrafluoroethylene, for example "Teflon 30N" from Dupont de Nemours, in an aqueous dispersion or in an aromatic polyamide in solvent phase (N-methyl-pyrrolidone), such as "Imitec 302" from the Imitec Corporation.

The underlayer 14 may be pigmented with dark brown or black so as to facilitate laser beam absorption and to contrast with the outer layer 13. The pigments used may be dark brown pigment sold by BASF under the name "Marron Sicopal K 2795" or black pigment sold by Ferro under the name "FA 2306" or a combination of pigments, for example based on the two pigments mentioned.

The minimum thickness of such an underlayer 14 must be sufficient to allow it to prevent the laser beam 10 from penetrating. Thus, when the underlayer is made of polytetrafluoroethylene, its radial thickness should be about 25 micrometers. When using an aromatic polyamide underlayer, this thickness is about 15 micrometers.

In the first type of underlayer, the pigment concentration should lie between 5% and 15%, while the second type of underlayer it should lie betweeen 30% and 35%, so as to retain good mechanical properties in the underlayer and to obtain sufficient coloring. The outer layer 13 should be such as to absorb just enough of the laser beam to give rise to its own pyrolysis. It should be as little absorbent as possible while still being burnable by the laser beam.

The outer layer may be constituted by an aqueous dispersion in polytetrafluroethylene (PTFE) of the same type as the underlayer 14, or by a polyurethane varnish, e.g. the product sold by BAYER comprising a compound of "Desmophen F951" which is a polyol and "Desmodur CT" which is a polyisocyanate, in solution in a mixture of cresol and xylene, for example.

The layer 13 may be pigmented using titanium dioxide white pigment in any of its forms, e.g. rutile or anatase, such as "Kronos RN59" sold by NL Chemicals.

This white pigment may be used on its own or mixed with small quantities of colored pigment in order to obtain pale or pastel tones.

With an aqueous dispersion of PTFE, the pigment concentration should lie in the range 10% to 15%, whereas with a polyurethane varnish it should lie in the range 30% to 100%.

The maximum thickness for such a layer is a function of the type of laser used and its emission power. The laser must be capable of volatilizing said layer so as to reveal the dark underlayer 14.

Thus, if a YAG laser is used, e.g. pulsed at 5 kHz and with a power of 5.6 watts, the thickness of said layer preferably lies in the range 5 micrometers to 20 micrometers when the outer layer 13 is of the first type mentioned, and in the range 5 micrometers to 25 micrometers when the outer layer 13 is of the second type mentioned.

Naturally, it would also be possible to use a $CO_2$ laser.

In order to obtain good temperature performance of the cable, further underlayers may be disposed beneath the outer layer 13 and the underlayer 14, e.g. polyimides such as "Liquid H" from Dupont de Nemours or the varnish "Imitec 201" from Imitec.

This underlayer is then pigmented in the same way as the underlayer 14 so that the set of polyimide and polyamide underlayers has a minimum thickness of about 15 micrometers.

The varnishes used are baked using the conventional procedures employed in the enamelled wire industry, for example by multipass coating using continuous dynamic baking in an oven by the die process or the dip process. Other varnish-depositing techniques may also be used, or example electrophoresis, electrostatic powdering and/or in a fluidized bath.

Laser marking in accordance with the invention may be performed on a machine of the type described in U.S. Pat. No. 4,370,542 which provides for relative positioning between a cable and a laser source.

Such marking may also be obtained by displacing a mask in a broad laser beam as obtained, for example, from a $CO_2$ laser (the "mask" process), with the laser beam being focussed after passing through said mask.

Marking in accordance with the invention may be applied to electric cables in particular for use in the aerospace industry. Thus, FIGS. 2 and 3 show two embodiments of such laser-markable cables in accordance wih the invention.

Figure 2:
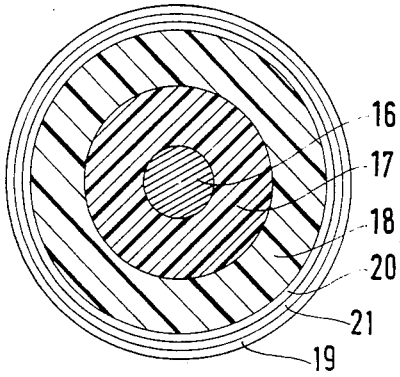
FIGS. 2 and 3 show two embodiments of laser-markable cables in accordance with the invention.
Figure 3:
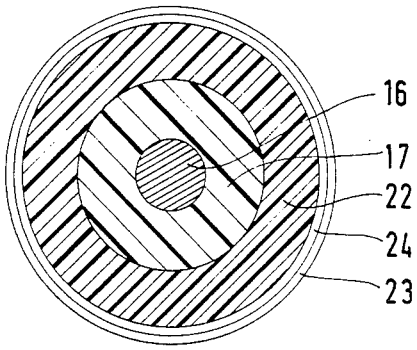

The cable shown in FIG. 2 is constituted:

by a central conductor 16 made of copper, a copper alloy, aluminum, or an aluminum alloy, and may optionally be protected by a metal coating (tin, nickel, silver, etc. . . ); and by three-layer insulation comprising:

two taped layers 17 and 18 made of polyimide with aa backing of hot setting adhesive, and which is fixed in place by heat treatment ("Kapfon F", "Kapfon HFE" trademarks filed by Dupont de Nemours, "Upilex F" trademark filed by U.B.E. Industries, "Apica AF" trademark filed by Kanegafuchi); and a third outer layer constituted by a set of three varnishes 20, 21, and 19 coated in succession; the layer 20 being a polyimide which is black in color; the layer 21 being an aromatic polyamide which is black in color; and the layer 19 being a polyurethane which is white in color; all three varnishes have an operating temperature of greater than 150° C.

The cable shown in FIG. 3 is constituted:

by a central conductor 16; and by a three-layer insulation comprising:

a first taped layer 17 made of polyimide as described in the above example;

a second taped or extruded layer 22 made of a thermoplastic material having a melting temperature of not less than 150° C. and fixed in position by heat treatment: polytetrafluoroethylene ("Teflon PTFE", trademark filed by Dupont de Nemours), perfluoroalkoxy - polytetrafluoroethylene ("Teflon PFA", trademark filed by Dupont de Nemours, "Hostaflon TFA", trademark filed by Hoeschst), polyetrafluoroethelene-propylene ("Teflon FEP", trademark filed by Dupont de Nemours), polyethylene-tetrafluoroethylene ("Tefzel", trademark filed by Dupont de Nemours), vinylidene polyfluoride ("Kynar", trademark filed by Pennwalt), polyether-ether-cetone ("Peek", trademark filed by I.C.I.) and a third outer layer constituted by a set of two varnishes 24 and 23 coated in succession: the layer 24 is black colored PTFE and the layer 23 is white colored PTFE. These two varnishes have an operating temperature of not less than 260° C.

Marking in accordance with the invention can also be applied to electric cable structures, in particular for aerospace use, having improved electrical characteristics as described in French Pat. No. 2 555 799.

A cable in accordance with the invention can thus be marked by burning through a thin outer layer which is either pre-existing or which is added for the purpose, with the holes thus created in said layer revealing the underlying insulation. The insulation must satisfy the electrical, mechanical, etc. requirements imposed on the cable in question, and in addition it must be capable of withstanding laser radiation whose power is adjusted to a level which is just sufficient to burn through the thin outer layer.

Naturally, the present invention has only been described and shown by way of preferred example, and its component parts could be replaced by equivalent parts without thereby going beyond the scope of the invention.

We claim:

1. An insulated electric cable suitable for being marked by a laser beam and including an outer surface layer enabling such marking to be performed and an underlayer immediately underlying said outer surface layer, said outer surface layer being of a contrasting color relative to the color of said underlayer, said outer surface layer being a layer which is thin relative to said underlayer and of a material which is not substantially more absorbent at the laser beam wavelength than is necessary to effect its own pyrolysis, said underlayer being of a material highly absorbent at the laser beam wavelength and of sufficient thickness such that the laser beam is fully dissipated therein without penetrating therethrough and destroying the underlayer, whereby during marking, the outer, thin surface layer is destroyed through its entire thickness by the laser beam so as to reveal the underlayer.

2. An electric cable according to claim 1, wherein the outer layer is pale in color, while the underlayer is dark in color.

3. An insulated electric cable suitable for being marked by a laser beam and including an outer surface layer enabling such marking to be performed and an underlayer immediately underlying said outer surface layer, said outer surface layer being of a contrasting color relative to the color of said underlayer, said outer surface layer being a layer which is sufficiently thin such that, during marking, the outer surface layer is destroyed through its entire thickness by the laser beam so as to reveal the underlayer, wherein the outer surface layer is between 5 micrometers and 50 micrometers thick, whereas the underlayer has a minimum thickness lying in the range of 15 micrometers to 30 micrometers.

4. An electric cable according to claim 1, wherein the underlayer is made of polytetrafluoroethylene from an aqueous dispersion.

5. An insulated electric cable suitable for being marked by a laser beam and including an outer surface layer enabling such marking to be performed and an underlayer immediately underlying said outer surface layer, said outer surface layer being of a contrasting color relative to the color of said underlayer, said outer surface layer being a layer which is sufficiently thin such that, during marking, the outer surface layer is destroyed through its entire thickness by the laser beam so as to reveal the underlayer, wherein the underlayer is made of polytetrafluoroethylene from an aqueous dispersion and includes 5% to 15% dark pigment.

6. An electric cable according to claim 1, wherein the underlayer is made of aromatic polyamide.

7. An insulated electric cable suitable for being marked by a laser beam and including an outer surface layer enabling such marking to be performed and an underlayer immediately underlying said outer surface layer, said outer surface layer being of a contrasting color relative to the color of said underlayer, said outer surface layer being a layer which is sufficiently thin such that, during marking, the outer surface layer is destroyed through its entire thickness by the laser beam so as to reveal the underlayer, wherein the underlayer is made of aromatic polyamide and includes 30% to 35% dark pigment.

8. An electric cable according to claim 1, wherein the outer layer is made of an aqueous dispersion of polytetrafluoroethylene.

9. An insulated electric cable suitable for being marked by a laser beam and including an outer surface layer enabling such marking to be performed and an underlayer immediately underlying said outer surface layer, said outer surface layer being of a contrasting color relative to the color of said underlayer, said outer surface layer being a layer which is sufficiently thin such that , during marking, the outer surface layer is destroyed through its entire thickness by the laser beam so as to reveal the underlayer, wherein the underlayer is made of an aqueous dispersion of polytetrafluoroethylene and includes 5% to 15% white pigment.

10. An electric cable according to claim 1, wherein the outer layer is made of polyurethane varnish.

11. An insulated electric cable suitable for being marked by a laser beam and including an outer surface layer enabling such marking to be performed and an underlayer immediately underlying said outer surface layer, said outer surface layer being of a contrasting color relative to the color of said underlayer, said outer surface layer being a layer which is sufficiently thin such that, during marking, the outer surface layer is destroyed through its entire thickness by the laser beam so as to reveal the underlayer, wherein the outer layer is made of polyurethane varnish and includes 30% to 100% white pigment.

12. An insulated electric cable suitable for being marked by a laser beam and including an outer surface layer enabling such marking to be performed and an underlayer immediately underlying said outer surface layer, said outer surface layer being of a contrasting color relative to the color of said underlayer, said outer surface layer being a layer which is sufficiently thin such that, during marking, the outer surface layer is destroyed through its entire thickness by the laser beam so as to reveal the underlayer, said cable comprising in succession, a central conductor; first and second insulating layers which are taped layers backed with adhesive and fixed by heat treatment, said taped layers being disposed around said central conductor, and said second insulating layer being coated with a third insulating layer constituted by three successive varnishes: a polyimide varnish which is black in color; then an aromatic polyamide varnish which is black in color; and then a polyurethane varnish which is white in color.

13. An insulated electric cable suitable for being marked by a laser beam and including an outer surface layer enabling such marking to be performed and an underlayer immediately underlying said outer surface layer, said outer surface layer being of a contrasting color relative to the color of said underlayer, said outer surface layer being a layer which is sufficiently thin such that, during marking, the outer surface layer is destroyed through its entire thickness by the laser beam so as to reveal the underlayer, said cable comprising in succession: a central conductor; a first taped layer of insulation; a second taped layer of insulation which is extruded at a melting temperature of not less than 150° C., said first and second layers of insulation being disposed around said central conductor, and said second layer being surrounded by a third layer constituted by two varnishes in succession: a polytetrafluoroethylene varnish which is black in color; then an aromatic polyamide varnish which is black in color; and then a polytetrafluoroethylene varnish which is white in color.

* * * * *